United States Patent [19]

Kopatz et al.

[11] Patent Number: 4,755,353

[45] Date of Patent: Jul. 5, 1988

[54] PROCESS FOR PRODUCING METAL FOILS

[75] Inventors: Nelson E. Kopatz, Sayre; Jack E. Vanderpool, Laceyville, both of Pa.; Philip E. Stermer, Waverly, N.Y.; Howard H. Shaw, Monroeton, Pa.

[73] Assignee: GTE Products Corporation, Stamford, Conn.

[21] Appl. No.: 33,706

[22] Filed: Apr. 3, 1987

[51] Int. Cl.[4] ..... B22F 7/00

[52] U.S. Cl. ..... 419/9; 419/23; 419/62; 164/46; 164/107; 427/191; 427/192

[58] Field of Search ..... 419/5, 8, 3, 23, 9, 419/61, 62; 427/191, 192; 164/46, 107

[56] References Cited

U.S. PATENT DOCUMENTS 2,974,041 3/1961 Brennan ..... 75/208

4,269,868 5/1981 Livsey ..... 427/53.1

4,300,474 11/1981 Livsey ..... 427/53.1

4,486,470 12/1984 Stuck et al. ..... 427/196

4,539,930 9/1985 Stuck et al. ..... 427/196

*Primary Examiner*—Stephen J. Lechert, Jr.

*Attorney, Agent, or Firm*—Donald R. Castle; L. Rita Quatrini

[57] ABSTRACT

A process is disclosed for producing discontinuous metal foils. The process involves entraining metal powder particles in a carrier gas and passing the powder particles through a high temperature zone at a temperature above the melting point of the powder particles to melt at least about 50% by weight of the powder particles and thereafter resolidifying the resulting high temperature treated material by impacting the material against a substrate to form the foils.

6 Claims, 1 Drawing Sheet

PROCESS FOR PRODUCING METAL FOILS

This invention relates to a process for producing discontinuous metal foils by impacting high temperature treated material against a substrate. More particularly, the high temperature treatment is a plasma process.

BACKGROUND OF THE INVENTION

Metal flakes, in particular those made by rapid solidification, are useful in applications such as pigments, electromagnetic shielding, and powder metallurgical applications.

Up to this time, metal flakes have been made by producing foils by melt spinning or melt extraction processes. The foils which are produced must be broken down further to shorter length foils, called discontinuous foils. The discontinuous foils are then broken down further into flakes which are used in the application.

It would be advantageous to produce discontinuous foils directly from starting material without having to go through extra or separate processing.

The process of the present invention produces discontinuous foils directly from the starting material without extra or separate processing steps.

SUMMARY OF THE INVENTION

In accordance with one aspect of this invention, there is provided a process for producing discontinuous metal foils. The process involves entraining metal powder particles in a carrier gas and passing the powder particles through a high temperature zone at a temperature above the melting point of the powder particles to melt at least about 50% by weight of the powder particles and thereafter resolidifying the resulting high temperature treated material by impacting the material against a substrate to form the foils.

DETAILED DESCRIPTION OF THE INVENTION

Figure 1:
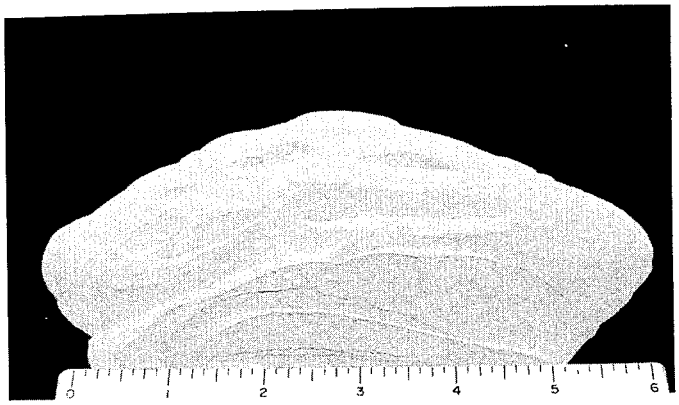
FIG. 1 is a photograph of copper powder which is a typical starting powder of the present invention.

For a better understanding of the present invention, together with other and further objects, advantages and capabilities thereof, reference is made to the following disclosure and appended claims in connection with the above described figures and description of some of the aspects of the invention.

The starting material of this invention can be essentially any type of metal powder particles such as agglomerated, atomized, elemental, alloy, or pre-alloyed powders. The powders can be crushed or irregular. Examples of metal powders that are especially suited to the practice of this invention are copper, stainless steel, tungsten heavy metal alloys such as tungsten alloys with iron and nickel, and iron-neodinium-boron alloys.

The size of the starting powder particles is preferably from about 20 to about 200 and preferably from about 40 to about 100 micrometers in diameter. The particle size measurement is done by conventional sieve analysis.

If necessary, the starting powders are exposed to high temperatures and controlled environment to remove carbon and oxygen, etc.

The powders are entrained in a carrier gas such as argon and passed through a high temperature zone at a temperature above the melting point of the powders for a sufficient time to melt at least about 50% by weight of the powders. The preferred high temperature zone is a plasma.

Details of the principles and operation of plasma reactors are well known. The plasma has a high temperature zone, but in cross section the temperature can vary typically from about 5500° C. to about 17,000° C. The outer edges are at low temperatures and the inner part is at a higher temperature. The retention time depends upon where the particles entrained in the carrier gas are injected into the nozzle of the plasma gun. Thus, if the particles are injected into the outer edge, the retention time must be longer, and if they are injected into the inner portion, the retention time is shorter. The residence time in the plasma flame can be controlled by choosing the point at which the particles are injected into the plasma. Residence time in the plasma is a function of the physical properties of the plasma gas and the powder material itself for a given set of plasma operating conditions and powder particles. Larger particles are more easily injected into the plasma while smaller particles tend to remain at the outer edge of the plasma jet or are deflected away from the plasma jet.

As the material passes through the plasma and cools, it is rapidly solidified. According to this invention, the solidification is accomplished by impacting the high temperature treated or molten material against a substrate to form the foils.

The nature of the substrate can vary with the type of metal foil which is to be produced. But generally, the substrates are pyrolitic graphite, pyrolitic boron nitride, or molybdenum which is preferably polished molybdenum.

The nature of the substrate allows the foils thus produced to be released from the substrate without any outside means.

Particle shape and/or size is altered by impacting the molten particles against a substrate and causing them to deform.

In accordance with a preferred embodiment of this invention, the resolidification is accomplished by impacting the molten material against a substrate which is a rapidly spinning, cooled polished molybdenum substrate. The preferred coolant is liquid nitrogen. One preferred material that is made into foils by this preferred method is copper.

The size of the foils is typically from about 50 to about 200 micrometers in thickness. When copper foil is made using the above preferred substrate the thickness is typically from about 100 to about 150 micrometers. When iron, stainless steel, and aluminum alloys are processed by the above preferred substrate, the thickness is typically about 50 micrometers. The length is typically no greater than about 50 millimeters, with from about 5 millimeters to about 50 millimeters being the preferred length. In the sense that the foils have some limitations as far as their length, they are called discontinuous foils. The width of the foils is typically from about 5 millimeters to about 25 millimeters.

Prior methods of making metal foils require that the foils so produced be broken down prior to use. By this invention discontinuous foils are produced directly from starting materials and are more readily converted into fine particulate flakes.

After cooling and resolidification, the resulting high temperature treated material can be classified by screening to remove the out of size or shape material and obtain the desired size foils, and to remove the excessively fine material such as that which is equivalent to the starting size. The unmelted minor portion can then be reprocessed according to the invention to convert it to foils.

To more fully illustrate this invention, the following nonlimiting example is presented.

Example

Figure 2:
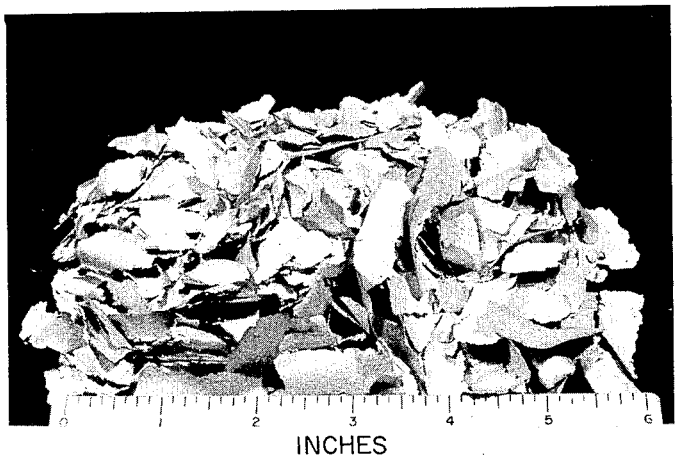
FIG. 2 is a photograph of large discontinuous foils produced by the process of the present invention.
Figure 3:
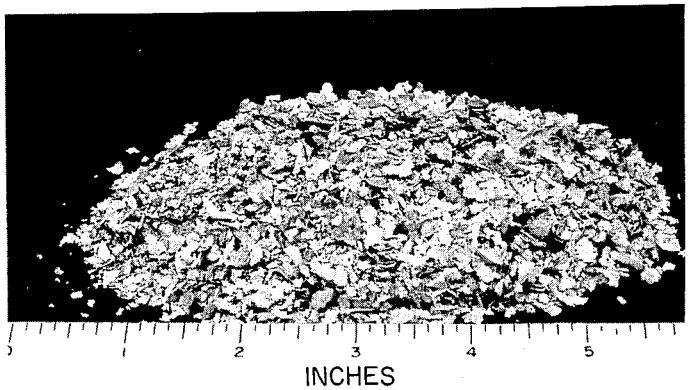
FIG. 3 is a photograph of smaller discontinuous foils produced by the process of the present invention.

An argon-helium plasma flame is generated with a gas glow of about 20 l/min. Ar and about 20 l/min. He with about 14 kilowatts of input power of about 400 amps and about 35 volts. The power can be typically from about 10 to about 80 kilowatts. Copper powder, shown in FIG. 1, having a particle size of from about 40 to about 70 micrometers is introduced into the plasma flame at a rate of about 75 g/min. being fed by a carrier gas at a flow rate of about 3 l/min. The flow rate of the carrier gas can be typically from about 1 to about 10 l/min. The powder is melted in flight in the plasma and impinges on a rapidly spinning (about 2,000 to about 10,000 rpm) polished molybdenum disc cooled with liquid nitrogen and located about 4" below the nozzle. Discontinuous foils are released from the substrate. FIGS. 2 and 3 show large and smaller foils produced by this process. The relative sizes of the foils in the two figures are indicated by the scale.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing discontinuous metal foils, said process comprising:

(a) entraining metal powder particles in a carrier gas and passing said powder particles through a high temperature zone at a temperature above the melting point of said powder particles to melt at least about 50% by weight of said powder particles; and (b) resolidifying the resulting high temperature treated particles by impacting said material against a substrate, said substrate being made of a material which allows said high temperature treated material to be released from said substrate without outside means, to form said foils.

2. A process of claim 1 wherein said metal powder particles are agglomerated prior to being entrained in said carrier gas and being passed through said high temperature zone.

3. A process of claim 1 wherein said high temperature zone is a plasma.

4. A process of claim 1 wherein said resolidification is accomplished by impacting said high temperature treated material against a substrate which is made of material selected from the group consisting of pyrolitic graphite, pyrolitic boron nitride, and molybdenum.

5. A process of claim 4 wherein said powder is selected from the group consisting of copper, tungsten heavy metal alloys, iron-neadymium-boron alloys, and stainless steel.

6. A process of claim 1 wherein after said resolidifcation, said high temperature treated material is classified to obtain the desired size of said foils.

* * * * *